United States Patent [19]

Abell, Jr. et al.

[11] Patent Number: 5,003,140

[45] Date of Patent: Mar. 26, 1991

[54] LONG KEYBUTTON STABILIZER

[75] Inventors: William A. Abell, Jr., Wilmore; David A. Bruner, Versailles, both of Ky.

[73] Assignee: International Business Machines Corporation, Armonk, N.Y.

[21] Appl. No.: 371,366

[22] Filed: Jun. 26, 1989

[51] Int. Cl.[5] ..... H01H 13/00

[52] U.S. Cl. ..... 200/344

[58] Field of Search ..... 200/314, 345, 341, 343; 400/496

[56] References Cited

U.S. PATENT DOCUMENTS

| | | | |
|---|---|---|---|
| 2,182,856 | 12/1939 | Riche | 200/459 |
| 2,340,615 | 2/1944 | Rath | 200/460 |
| 4,055,734 | 10/1977 | Hayden | 200/5A |
| 4,311,893 | 1/1982 | Tsuchiya et al. | 200/344 |
| 4,392,037 | 7/1983 | Fleming | 200/344 |

FOREIGN PATENT DOCUMENTS

| | | | |
|---|---|---|---|
| 0267541 | 11/1986 | European Pat. Off. . | |
| 0271124 | 11/1986 | European Pat. Off. . | |
| 2933150 | 2/1981 | Fed. Rep. of Germany | 200/343 |

*Primary Examiner*—Renee S. Luebke

*Attorney, Agent, or Firm*—Laurence R. Letson

[57] ABSTRACT

A long keybutton is stablized with a pair of arms and an interconnecting shaft. The ends of the arms are connected to the keybutton using a thin serpentine section which distributes stress and forces to improve life of the part, and permits integral molded keybuttons. The integral molded part with the stability of the portions of the keybutton permits the automated assembly of the stabilized keybutton with the keyboard frame.

7 Claims, 1 Drawing Sheet

LONG KEYBUTTON STABILIZER

This invention relates to keyboards and more particularly to the keybuttons of a keyboard which are of extended length or configuration. The extended length or configuration of the keybutton requires stabilization for reliable operation.

BACKGROUND OF THE INVENTION

Keyboards for typewriters, computers, terminals and other similar devices have keybuttons which are referred to as long keys. These long keys are keybuttons which have a dimension which permits the depression of the key with a force which is displaced from the axis of movement by a sufficient distance that it will tend to cause the key to rotate and thus bind, resulting in faulty keybutton operation.

This problem of binding keybuttons and the resulting faulty operation has been addressed by using a stabilizer with the long key, and mounting the stabilizer on the keyboard frame. The stabilizer is most commonly a bent wire which is engaged with the keybutton at the wire's ends in slots formed in the keybutton. When the keybutton is depressed, the wire ends ride in the slot and act to rotate the stabilizer as the keybutton moves downward. The stabilizer acts to pull the end of the long key down to keep the long key properly oriented relative to the keyboard frame. An example of this type of stabilizer is shown in the IBM Technical Disclosure Bulletin, Vol. 24, No. 6, Nov. 1981, pp 2730–2731.

The fabrication of the stabilizer as a separate wire or member does not lend itself to automated assembly, since the wire must be assembled with the keybutton and then held in a particular position for insertion of the wire into the pivot or keeper. Since the wire stabilizer is free to move relative to the keybutton, it is very difficult to position the keybutton and the stabilizer properly with automation equipment for assembly with the keyboard frame.

It is an object of the invention to stabilize a long key of a keyboard in a manner that is conductive to the automated assembly of the key to the keyboard frame.

A better understanding of the invention may be had from the accompanying drawings and detailed description of the invention that follows.

DETAILED DESCRIPTION OF THE DRAWINGS

DETAILED DESCRIPTION OF THE INVENTION

Figure 1:
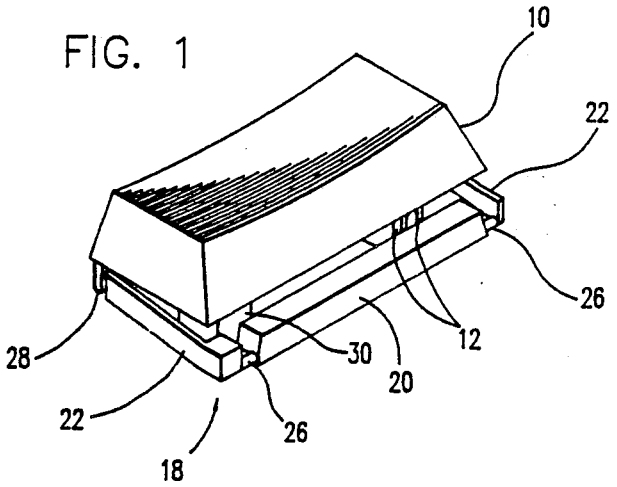
FIG. 1 shows the keybutton and integrated stabilizer of the invention, in a perspective view.
Figure 2:
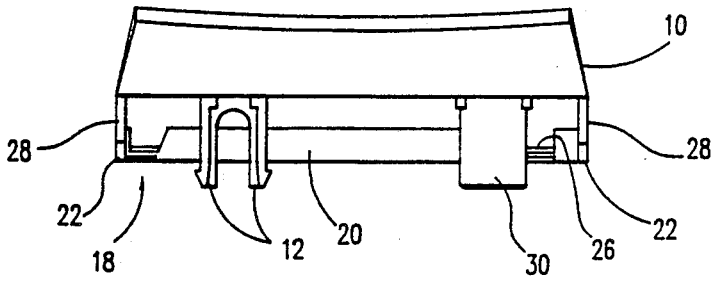
FIG. 2 shows the keybutton and stabilizer of the invention in a rear elevation view.
Figure 3:
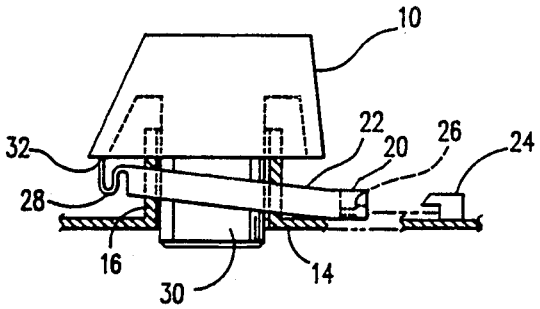
FIG. 3 shows the keybutton and stabilizer of the invention in a side elevation view as it is incorporated into the keyboard.

Referring to FIG. 1, the keybutton 10 is the type that has a length dimension such that the operator's finger will not, by necessity, be restricted to a position directly over the stem or appendage 12 which would extend down into the keyboard frame 14, as shown in FIG. 3. The stem 12 extends from the underside of the keybutton 10 into a portion of the frame 14 which is referred to as the chimney 16. The stem 12 and the chimney 16 coact to guide the reciprocal movement of the keybutton 10. Due to the relatively short length of the stem in relation to the thickness or width of the stem, it is possible to cock or tilt the keybutton 10 with respect to the frame 14 and the chimney 16. This cocking causes a bind and the keybutton 10 will not function properly.

In order to prevent the cocking of the keybutton 10, it is necessary to cause both ends of the keybutton 10 to be moved toward the frame 14 simultaneously. This is accomplished by the stabilizer 18 which comprises a shaft 20 and two arms 22. The shaft 20 is mounted in a pivot 24, a loose retainer, which acts with the chimney 16 to retain and locate shaft 20. The pivot is best seen in FIG. 3. The shaft 20 may be of any desired cross sectional shape with those portions of the shaft 20 which engage the pivots 24, being at least a partial cylindrical shape 26. The partial cylindrical shape 26 permits the shaft 20 to be rotated relative to the pivot 24 freely.

The shaft 20 is rotated by a movement generated by a force exerted on one of the arms 22 at the end that is not attached to the shaft 20. If a force is generated at the end of one of the arms 22, causing the rotation of the shaft 20, the arm 22 attached to the other end of the shaft 20 is caused to rotate in synchronization with the arm 22 that the force is acting upon. As the arm 22, being rotated by the shaft 20, moves in response to the shaft rotation, the end thereof acts to exert a force on the keybutton 10 to pull the end of the keybutton 10 toward the frame 14. This pulling keeps the keybutton 10 properly oriented with respect to the chimney 16 to prevent the binding of the stem 12 in the chimney 16. The keybutton 10 can be provided with a dummy stem 30 so that if the force is exerted in the region of the dummy stem 30, the end of the keybutton 10 is guided by the dummy stem 30, and the end of the keybutton 10 nearest the stem 12 is pulled toward the frame 14.

The connection of the arms 22 to the keybutton 10 is important in that the connection must be flexible and at the same time sufficient to withstand the repeated stresses caused by the depression of the keybutton 10. The end of the arm 22 will tend to trace an arcuate path as it is moved about the axis of the shaft 20 while the path of the attachment point 32 to the keybutton 10 traces a linear path which tends to converge with the arcuate path just described. As the points tend to converge on their respective paths, the connection between the keybutton and the arm must be compliant, and will serve to keep the attachment point on the keybutton 10 and the end of the arm 22 spaced from each other.

The requirements of the connection can be efficiently met by a serpentine section 28 of molded plastic material which extends from the end of arms 22 to the keybutton 10. The serpentine section 28 provides several functions. The primary functions of the serpentine sections 28 are force transmission to or from the arm 22, and the provision of relative movement between the keybutton 10 and the arm 22 as the keybutton 10 is depressed and restored. The serpentine section flexes as there is relative movement between the arm 22 and the keybutton 10. The advantage of the serpentine section 28 over the type connection known as a living hinge is that the arm will exert a lower lateral force on the keybutton 10 due to flexing and that the flexing will be distributed over the length of the serpentine section 28, thus reducing the stress concentrations associated with the living hinge. The lateral forces, if any, act to shift the shaft laterally away from the axis of movement of the keybutton 10, under the constraint of the pivot. The pivot is positioned to allow some lateral movement of the shaft so that the flexural stresses in the serpentine section 28 are not compounded with the forces which would otherwise move the end of the arm 22 toward the connection point on keybutton 10. The result of the stress distribution is that the connection will withstand a much higher number of repeated stress cycles. When surface 26 is engaged with pivot 24 and the keybutton is depressed, the length of the arm from the connection 32 to the pivot 24 changes and the flexible lateral movement permitting connection 28 between the keybutton 10 and arm 22 accommodates such change in length.

The pivot 24 may be molded as a part of the keyboard frame 14. The pivot 24 is a retaining journal or keeper which mates with and captures the partial cylindrical surfaces 26.

Since the serpentine section 28 is rigid enough to support the arms 22 and shaft 20, the keybutton 10 may be picked up and placed into the frame 14 of the keyboard. As the keybutton and the attached arms 22 and shaft 20 are inserted into the frame 14, the serpentine section will flex to permit the partial cylindrical section 26 to engage with the pivot 24 and to be trapped by the pivot 24. As the shaft 20 and the arms 22 are held in a fixed position relative to the keybutton 10, the keybutton 10 is capable of being efficiently inserted and assembled by automated equipment.

As the keybutton 10 is depressed, the movement of the keybutton downward rotates at least one of the arms 22 of the stabilizer to rotate the shaft 20. The shaft rotation causes the other arm 22 to move pulling the keybutton toward the frame 14 evenly, preventing binding of the stem 12 and chimney 16.

I claim:

1. A keybutton for use on a keyboard comprising:

a main body member;

at least one appendage formed as a stem extending from said main body member for sliding engagement within a mating sleeve forming a part of said keyboard;

a stabilizer;

said stabilizer comprising an integrally molded shaft rotatably engageable with and retainable in a fixed location relative to said keyboard, by said keyboard and arms extending radially from said shaft and said arms parallel to each other; and a serpentine flexible connecting section interconnecting said main body member to each of said arms, whereby the depression of said main body member by a force at a location other than directly aligned with said appendage will cause a displacement of one of said arms closest to said location, along with rotational movement of said shaft, which in turn displaces the other of said arms to pull said main body member at a point to which said other of said arms is attached, in coordinated movement with the displacement of a point of said member engaged by said force.

2. The keybutton of claim 1 wherein said shaft comprises at least a partially complete cylindrical surface formed proximate both ends of said shaft.

3. The keybutton of claim 1 wherein said main body member has at least two said appendages extending therefrom.

4. A keyboard comprising:

a frame having a plurality of hollow sleeves extending therefrom;

a plurality of retainer pivot means supported by said frame and proximate at least one of said sleeves; and at least one keybutton, engaged with at least one of said sleeves and said shaft engaged with said retainer pivot means;

said keybutton comprising;

a main body member;

at least one appendage formed as a stem extending from said main body member for sliding engagement within a mating sleeve forming a part of said keyboard;

a stabilizer;

said stabilizer comprising an integrally molded shaft rotatably engageable with and retainable by said keyboard in a fixed location relative to said keyboard, and arms extending radially from said shaft and said arms parallel to each other; and a serpentine flexible connecting section interconnecting said main body member to each of said arms, whereby the depression of said main body member by a force at a location other than directly aligned with said appendage will cause a displacement of one of said arms closest to said location, along with rotational movement of said shaft, which in turn displaces the other of said arms to pull said main body member at a point to which said other of said arms is attached, in coordinated movement with the displacement of a point of said member engaged by said force.

5. A keybutton for use on a keyboard, which includes a main body portion having a top surface and a left and right end, a left arm portion and a right arm portion each extending downwardly from said main body portion and integrally formed therewith by a flexible, lateral movement permitting connection, and a shaft portion linking the left and right arm portions for unified movement, so that when the keybutton is mounted on a keyboard with the shaft portion movably secured thereon, downward movement of one end of said main body portion and one of the arm portions results in downward movement of the other arm portion and the other end of the main body portion.

6. The keybutton of claim 5 where the main body portion and said arms are connected by a flexible connection.

7. The keybutton of claim 6 wherein said flexible connection is a portion of the integral keybutton and arms formed in a serpentine form, forming said connection.

* * * * *